US007550642B2

(12) United States Patent
Powers

(10) Patent No.: US 7,550,642 B2
(45) Date of Patent: Jun. 23, 2009

(54) OLEFIN PRODUCTION UTILIZING WHOLE CRUDE OIL/CONDENSATE FEEDSTOCK WITH ENHANCED DISTILLATE PRODUCTION

(75) Inventor: Donald H. Powers, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 383 days.

(21) Appl. No.: 11/584,722

(22) Filed: Oct. 20, 2006

(65) Prior Publication Data

US 2008/0093261 A1 Apr. 24, 2008

(51) Int. Cl.
*C07C 4/04* (2006.01)
*C10G 9/00* (2006.01)

(52) U.S. Cl. ..... 585/648; 585/652; 208/130; 208/132

(58) Field of Classification Search ..... 585/648, 585/652; 208/130, 132
See application file for complete search history.

(56) References Cited

U.S. PATENT DOCUMENTS 5,013,427 A * 5/1991 Mosby et al. ..... 208/211
5,817,226 A 10/1998 Lenglet ..... 208/130
6,743,961 B2 6/2004 Powers ..... 585/648
6,979,757 B2 12/2005 Powers ..... 585/648
7,019,187 B2 3/2006 Powers ..... 585/648
2004/0039240 A1 2/2004 Powers ..... 585/652
2005/0209495 A1 * 9/2005 McCoy et al. ..... 585/648
2005/0261536 A1 11/2005 Stell et al. ..... 585/648

FOREIGN PATENT DOCUMENTS

EP 0 427 854 4/1989

OTHER PUBLICATIONS

Jones, D.S. J., "Elements of petroleum processing", 1995, *John Wiley & Sons Ltd.*, XP-002503627, p. 22 paragraph 2—p. 23, paragraph 4.

* cited by examiner

*Primary Examiner*—Walter D Griffin
*Assistant Examiner*—Renee Robinson
(74) *Attorney, Agent, or Firm*—Roderick W. MacDonald

(57) ABSTRACT

A method processing a liquid crude and/or natural gas condensate feed comprising subjecting the feed to a vaporization step to form a vaporous product and a liquid product, subjecting the vaporous product to severe thermal cracking, and subjecting the liquid product to crude oil refinery processing.

8 Claims, 2 Drawing Sheets

OLEFIN PRODUCTION UTILIZING WHOLE CRUDE OIL/CONDENSATE FEEDSTOCK WITH ENHANCED DISTILLATE PRODUCTION

BACKGROUND OF INVENTION

1. Field of the Invention

This invention relates to the formation of olefins by thermal cracking of liquid whole crude oil and/or condensate derived from natural gas in a manner that is integrated with a crude oil refinery. More particularly, this invention relates to utilizing whole crude oil and/or natural gas condensate as a feedstock for an olefin production plant that employs hydrocarbon thermal cracking in a pyrolysis furnace, and a crude oil refinery in a manner that preserves distillate range components from the cracking function.

2. Description of the Prior Art

Thermal (pyrolysis) cracking of hydrocarbons is a non-catalytic petrochemical process that is widely used to produce olefins such as ethylene, propylene, butenes, butadiene, and aromatics such as benzene, toluene, and xylenes.

Basically, a hydrocarbon feedstock such as naphtha, gas oil or other fractions of whole crude oil that are produced by distilling or otherwise fractionating whole crude oil, is mixed with steam which serves as a diluent to keep the hydrocarbon molecules separated. The steam/hydrocarbon mixture is preheated to from about 900 to about 1,000 degrees Fahrenheit (° F. or F.), and then enters the reaction zone where it is very quickly heated to a severe hydrocarbon thermal cracking temperature in the range of from about 1,450 to about 1,550 F. Thermal cracking is accomplished without the aid of any catalyst.

This process is carried out in a pyrolysis furnace (steam cracker) at pressures in the reaction zone ranging from about 10 to about 30 psig. Pyrolysis furnaces have internally thereof a convection section and a radiant section. Preheating is accomplished in the convection section, while severe cracking occurs in the radiant section.

After severe thermal cracking, the effluent from the pyrolysis furnace contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas also contains significant amounts of molecular hydrogen (hydrogen).

Thus, conventional steam (thermal) cracking, as carried out in a commercial olefin production plant, employs a fraction of whole crude and totally vaporizes that fraction while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of said product, with the remainder consisting mostly of other hydrocarbon molecules having from 4 to 35 carbon atoms per molecule.

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream and generates there from a plurality of separate, valuable products.

Natural gas and whole crude oil(s) were formed naturally in a number of subterranean geologic formations (formations) of widely varying porosities. Many of these formations were capped by impervious layers of rock. Natural gas and whole crude oil (crude oil) also accumulated in various stratigraphic traps below the earth's surface. Vast amounts of both natural gas and/or crude oil were thus collected to form hydrocarbon bearing formations at varying depths below the earth's surface. Much of this natural gas was in close physical contact with crude oil, and, therefore, absorbed a number of lighter molecules from the crude oil.

When a well bore is drilled into the earth and pierces one or more of such hydrocarbon bearing formations, natural gas and/or crude oil can be recovered through that well bore to the earth's surface.

The terms "whole crude oil" and "crude oil" as used herein means liquid (at normally prevailing conditions of temperature and pressure at the earth's surface) crude oil as it issues from a wellhead separate from any natural gas that may be present, and excepting any treatment such crude oil may receive to render it acceptable for transport to a crude oil refinery and/or conventional distillation in such a refinery. This treatment would include such steps as desalting. Thus, it is crude oil that is suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, whole crude oil could be one or more crude oils straight from an oil field pipeline and/or conventional crude oil storage facility, as availability dictates, without any prior fractionation thereof.

Natural gas, like crude oil, can vary widely in its composition as produced to the earth's surface, but generally contains a significant amount, most often a major amount, i.e., greater than about 50 weight percent (wt. %), methane. Natural gas often also carries minor amounts (less than about 50 wt. %), often less than about 20 wt. %, of one or more of ethane, propane, butane, nitrogen, carbon dioxide, hydrogen sulfide, and the like. Many, but not all, natural gas streams as produced from the earth can contain minor amounts (less than about 50 wt. %), often less than about 20 wt. %, of hydrocarbons having from 5 to 12, inclusive, carbon atoms per molecule (C5 to C12) that are not normally gaseous at generally prevailing ambient atmospheric conditions of temperature and pressure at the earth's surface, and that can condense out of the natural gas once it is produced to the earth's surface. All wt. % are based on the total weight of the natural gas stream in question.

When various natural gas streams are produced to the earth's surface, a hydrocarbon composition often naturally condenses out of the thus produced natural gas stream under the then prevailing conditions of temperature and pressure at the earth's surface where that stream is collected. There is thus produced a normally liquid hydrocarbonaceous condensate separate from the normally gaseous natural gas under the same prevailing conditions. The normally gaseous natural gas can contain methane, ethane, propane, and butane. The normally liquid hydrocarbon fraction that condenses from the produced natural gas stream is generally referred to as "condensate," and generally contains molecules heavier than butane (C5 to about C20 or slightly higher). After separation from the produced natural gas, this liquid condensate fraction is processed separately from the remaining gaseous fraction that is normally referred to as natural gas.

Thus, condensate recovered from a natural gas stream as first produced to the earth's surface is not the exact same material, composition wise, as natural gas (primarily methane). Neither is it the same material, composition wise, as crude oil. Condensate occupies a niche between normally gaseous natural gas and normally liquid whole crude oil. Condensate contains hydrocarbons heavier than normally gaseous natural gas, and a range of hydrocarbons that are at the lightest end of whole crude oil.

Condensate, unlike crude oil, can be characterized by way of its boiling point range. Condensates normally boil in the range of from about 100 to about 650 degrees Fahrenheit (F.). With this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like). Naphtha and associated lighter boiling materials (naphtha) are in the C5 to C10, inclusive, range, and are the lightest boiling range fractions in condensate, boiling in the range of from about 100 to about 400 F. Petroleum middle distillates (kerosene, diesel, atmospheric gas oil) are generally in the C10 to about C20 or slightly higher range, and generally boil, in their majority, in the range of from about 350 to about 650 F. They are, individually and collectively, referred to herein as "distillate" or "distillates." It should be noted that various distillate compositions can have a boiling point lower than 350 F and/or higher than 650 F, and such distillates are included in the 350-650 F range aforesaid, and in this invention.

The starting feedstock for a conventional olefin production plant, as described above, normally has first been subjected to substantial, expensive processing before it reaches that plant. Normally, condensate and whole crude oil is distilled or otherwise fractionated in a crude oil refinery into a plurality of fractions such as gasoline, naphtha, kerosene, gas oil (vacuum or atmospheric) and the like, including, in the case of crude oil and not natural gas, a high boiling residuum. Thereafter any of these fractions, other than the residuum, are normally passed to an olefin production plant as the starting feedstock for that plant.

It would be desirable to be able to forego the capital and operating cost of a refinery distillation unit (whole crude processing unit) that processes condensate and/or crude oil to generate a hydrocarbonaceous fraction that serves as the starting feedstock for conventional olefin producing plants. However, the prior art, until recently, taught away from even hydrocarbon cuts (fractions) that have too broad a boiling range distribution. For example, see U.S. Pat. No. 5,817,226 to Lenglet.

Recently, U.S. Pat. No. 6,743,961 (hereafter "USP '961") issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

Still more recently, U.S. Pat. No. 7,019,187 issued to Donald H. Powers. This patent is directed to the process disclosed in U.S. Pat. No. '961, but employs a mildly acidic cracking catalyst to drive the overall function of the vaporization/mild cracking unit more toward the mild cracking end of the vaporization (without prior mild cracking)—mild cracking (followed by vaporization) spectrum.

U.S. Pat. No. 6,979,757 to Donald H. Powers is directed to the process disclosed in U.S. Pat. No. '961, but that invention removes at least part of the liquid hydrocarbons remaining in the vaporization/mild cracking unit that are not yet vaporized or mildly cracked. These liquid hydrocarbon components of the crude oil feed are drawn from near the bottom of that unit and passed to a separate controlled cavitation device to provide additional cracking energy for those tenacious hydrocarbon components that have previously resisted vaporization and mild cracking. Thus, that invention also seeks to drive the overall process in the vaporization/mild cracking unit more toward the mild cracking end of the vaporization—mild cracking spectrum aforesaid.

The disclosures of the foregoing patents, in their entirety, are incorporated herein by reference.

U.S. patent application Ser. No. 11/219,166, filed Sep. 2, 2005, having common inventorship and assignee with U.S. Pat. No. '961, is directed to the process of using whole crude oil as the feedstock for an olefin plant to produce a mixture of hydrocarbon vapor and liquid. The vaporous hydrocarbon is separated from the remaining liquid and the vapor passed to a severe cracking operation.

During periods of increased gasoline demand, the gasoline supply (pool) can be increased by subjecting various crude oil fractions, including distillates, to various refinery catalytic cracking processes such as fluid catalytic cracking. Thus, the quantity of gasoline/naphtha produced from a barrel of crude oil can be increased if desired. This is not so with distillates as defined above. The amount of distillate recovered from a barrel of crude oil is fixed and cannot be increased as it can with gasoline. The only way to increase distillate production (supply) is by refining additional barrels of crude oil.

Thus, there are times when it is highly desirable to recover distillates from what would otherwise be feed for a thermal cracking furnace that forms olefins from such feed, and this invention provides just such a process.

By the use of this invention, valuable distillates that are in short supply can be separately recovered from a cracking feed and thus saved from being converted to less valuable cracked products. By this invention, not only is high quality distillate saved from cracking, but it is done so with greater thermal efficiency and lower capital expense than the approach that would have been obvious to one skilled in the art.

One skilled in the art would first subject the feed to be cracked to a conventional distillation column to distill the distillate from the cracking feed. This approach would require a substantial amount of capital to build the column and outfit it with the normal reboiler and overhead condensation equipment that goes with such a column. By this invention, a splitter is employed in a manner such that much greater energy efficiency at lower capital cost is realized over a distillation column. By this invention, reboilers, overhead condensers, and related distillation column equipment are eliminated without eliminating the functions thereof, thus saving considerably in capital costs. Further, this invention exhibits much greater energy efficiency in operation than a distillation column because the extra energy that would be required by a distillation column is not required by this invention since this invention instead utilizes for its splitting function the energy that is already going to be expended in the operation of the cracking furnace (as opposed to energy expended to operate a standalone distillation column upstream of the cracking furnace), and the vapor product of the splitter goes directly to the cracking section of the furnace.

Finally, this invention integrates the foregoing process with conventional refinery steps to maximize the efficient utilization of a barrel of crude oil/condensate by cracking low octane straight run naphtha, separating the scarce straight run distillate components, and maximizing high octane gasoline production through the integration of the process with crude oil refinery steps.

SUMMARY OF THE INVENTION

In accordance with this invention, there is provided a process for utilizing whole crude oil and/or natural gas condensate as the feedstock for an olefin plant, as defined above, which maximizes the recovery of distillate, as defined above, leaves as feed for the olefin plant, materials lower in boiling temperature than distillate, and maximizes the distillate recovery by integration of the process with crude oil refinery steps.

DETAILED DESCRIPTION OF THE INVENTION

Figure 1:
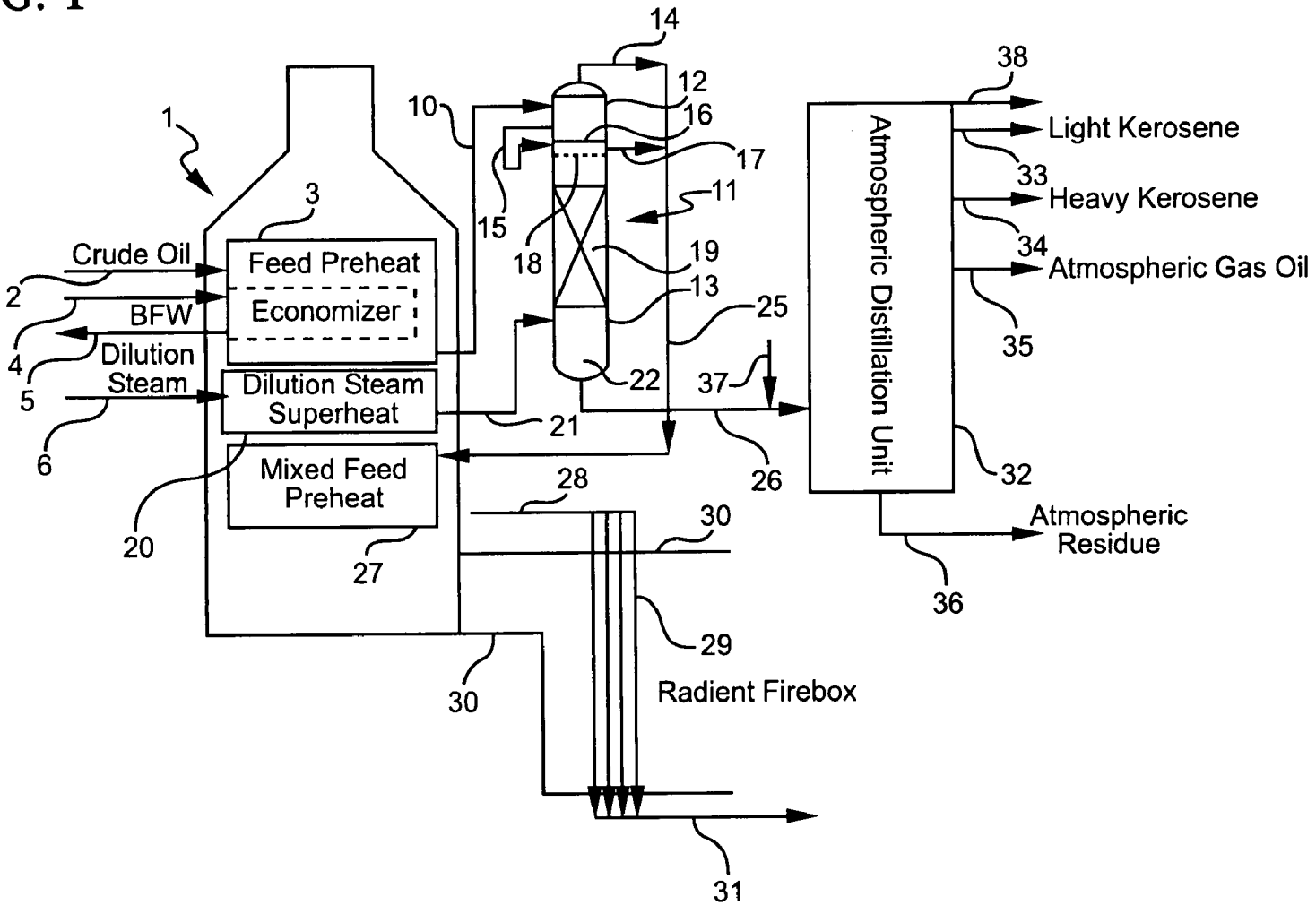
FIG. 1 shows a simplified flow sheet for one process within this invention.

The terms "hydrocarbon," "hydrocarbons," and "hydrocarbonaceous" as used herein do not mean materials strictly or only containing hydrogen atoms and carbon atoms. Such terms include materials that are hydrocarbonaceous in nature in that they primarily or essentially are composed of hydrogen and carbon atoms, but can contain other elements such as oxygen, sulfur, nitrogen, metals, inorganic salts, and the like, even in significant amounts.

The term "gaseous" as used in this invention means one or more gases in an essentially vaporous state, for example, steam alone, a mixture of steam and hydrocarbon vapor, and the like.

The term "coke" as used in this invention means any high molecular weight carbonaceous solid, and includes compounds formed from the condensation of polynuclear aromatics.

An olefin producing plant useful with this invention would include a pyrolysis (thermal cracking) furnace for initially receiving and cracking the feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the thermo "radiant section," where the hydrocarbons are heated to from about 1,450° F. to about 1,550° F. and thereby subjected to severe cracking.

The initially empty radiant coil is, therefore, a fired tubular chemical reactor. Hydrocarbon feed to the furnace is preheated to from about 900° F. to about 1,000° F. in the convection section by convectional heating from the flue gas from the radiant section, steam dilution of the feed in the convection section, or the like. After preheating, in a conventional commercial furnace, the feed is ready for entry into the radiant section.

In a typical furnace, the convection section can contain multiple zones. For example, the feed can be initially preheated in a first upper zone, boiler feed water heated in a second zone, mixed feed and steam heated in a third zone, steam superheated in a fourth zone, and the final feed/steam mixture preheated to completion in the bottom, fifth zone. The number of zones and their functions can vary considerably. Thus, pyrolysis furnaces can be complex and variable structures.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

Radiant coil designers strive for short residence time, high temperature and low hydrocarbon partial pressure. Coil lengths and diameters are determined by the feed rate per coil, coil metallurgy in respect of temperature capability, and the rate of coke deposition in the coil. Coils range from a single, small diameter tube with low feed rate and many tube coils per furnace to long, large-diameter tubes with high feed rate and fewer coils per furnace. Longer coils can consist of lengths of tubing connected with u-turn bends. Various combinations of tubes can be employed. For example, four narrow tubes in parallel can feed two larger diameter tubes, also in parallel, which then feed a still larger tube connected in series. Accordingly, coil lengths, diameters, and arrangements in series and/or parallel flow can vary widely from furnace to furnace. Furnaces, because of proprietary features in their design, are often referred to by way of their manufacturer. This invention is applicable to any pyrolysis furnace, including, but not limited to, those manufactured by Lummus, M. W. Kellog & Co., Mitsubishi, Stone & Webster Engineering Corp., KTI Corp., Linde-Selas, and the like.

Downstream processing of the cracked hydrocarbons issuing from the furnace varies considerably, and particularly based on whether the initial hydrocarbon feed was a gas or a liquid. Since this invention uses whole crude oil and/or liquid natural gas condensate as a feed, downstream processing herein will be described for a liquid fed olefin plant. Downstream processing of cracked gaseous hydrocarbons from liquid feedstock, naphtha through gas oil for the prior art, and crude oil and/or condensate for this invention, is more complex than for gaseous feedstock because of the heavier hydrocarbon components present in the liquid feedstocks.

With a liquid hydrocarbon feedstock downstream processing, although it can vary from plant to plant, typically employs an oil quench of the furnace effluent after heat exchange of same in, for example, the transfer-line exchanger aforesaid. Thereafter, the cracked hydrocarbon stream is subjected to primary fractionation to remove heavy liquids, followed by compression of uncondensed hydrocarbons, and acid gas and water removal there from. Various desired products are then individually separated, e.g., ethylene, propylene, a mixture of hydrocarbons having four carbon atoms per molecule, fuel oil, pyrolysis gasoline, and a high purity hydrogen stream.

In accordance with this invention, a process is provided which utilizes crude oil and/or condensate liquid that has not been subjected to fractionation, distillation, and the like, as the primary (initial) feedstock for the olefin plant pyrolysis furnace in whole or in substantial part. By so doing, this invention eliminates the need for costly distillation of the condensate into various fractions, e.g., from naphtha, kerosene, gas oil, and the like, to serve as the primary feedstock for a furnace as is done by the prior art as first described hereinabove.

By this invention, the foregoing advantages (energy efficiency and capital cost reduction) while using crude oil and/or condensate as a primary feed are accomplished. In so doing, complete vaporization of the hydrocarbon stream that is passed into the radiant section of the furnace is achieved while preserving distillate fractions initially present in the liquid condensate feed essentially in the liquid state for easy separation of same from the lighter, vaporous hydrocarbons that are to be cracked.

This invention can be carried out using, for example, the apparatus disclosed in U.S. Pat. No. '961. Thus, this invention is carried out using a self-contained vaporization facility that operates separately from and independently of the convection and radiant sections, and can be employed as (1) an integral section of the furnace, e.g., inside the furnace in or near the convection section but upstream of the radiant section and/or (2) outside the furnace itself but in fluid communication with the furnace. When employed outside the furnace, crude oil and/or condensate primary feed is preheated in the convection section of the furnace, passed out of the convection section and the furnace to a standalone vaporization facility. The vaporous hydrocarbon product of this standalone facility is then passed back into the furnace to enter the radiant section thereof. Preheating can be carried out other than in the convection section of the furnace if desired or in any combination inside and/or outside the furnace and still be within the scope of this invention.

The vaporization unit of this invention (for example section 3 of U.S. Pat. No. '961) receives the condensate feed that may or may not have been preheated, for example, from about ambient to about 350 F, preferably from about 200 to about 350 F. This is a lower temperature range than what is required for complete vaporization of the feed. Any preheating preferably, though not necessarily, takes place in the convection section of the same furnace for which such condensate is the primary feed.

Thus, the first zone in the vaporization operation step of this invention (zone 4 in U.S. Pat. No. '961) employs vapor/liquid separation wherein vaporous hydrocarbons and other gases, if any, in the preheated feed stream are separated from those distillate components that remain liquid after preheating. The aforesaid gases are removed from the vapor/liquid separation section and passed on to the radiant section of the furnace.

Vapor/liquid separation in this first, e.g., upper, zone knocks out distillate liquid in any conventional manner, numerous ways and means of which are well known and obvious in the art. Suitable devices for liquid vapor/liquid separation include liquid knock out vessels with tangential vapor entry, centrifugal separators, conventional cyclone separators, schoepentoeters, vane droplet separators, and the like.

Liquid thus separated from the aforesaid vapors moves into a second, e.g., lower, zone (zone 9 in U.S. Pat. No. '961). This can be accomplished by external piping. Alternatively this can be accomplished internally of the vaporization unit. The liquid entering and traveling along the length of this second zone meets oncoming, e.g., rising, steam. This liquid, absent the removed gases, receives the full impact of the oncoming steam's thermal energy and diluting effect.

This second zone can carry at least one liquid distribution device such as a perforated plate(s), trough distributor, dual flow tray(s), chimney tray(s), spray nozzle(s), and the like.

This second zone can also carry in a portion thereof one or more conventional tower packing materials and/or trays for promoting intimate mixing of liquid and vapor in the second zone.

As the remaining liquid hydrocarbon travels (falls) through this second zone, lighter materials such as gasoline or naphtha that may be present can be vaporized in substantial part by the high energy steam with which it comes into contact. This enables the hydrocarbon components that are more difficult to vaporize to continue to fall and be subjected to higher and higher steam to liquid hydrocarbon ratios and temperatures to enable them to be vaporized by both the energy of the steam and the decreased liquid hydrocarbon partial pressure with increased steam partial pressure.

FIG. 1 shows one embodiment of the process of this invention. FIG. 1, as well as FIG. 2 herein, is very diagrammatic for sake of simplicity and brevity since, as discussed above, actual furnaces are complex structures.

FIG. 1 shows a conventional cracking furnace 1 wherein a crude oil primary feed 2 is passed in to the preheat section 3 of the convection section of furnace 1. This preheat section 3 can also contain a conventional economizer wherein boiler feed water (BFW) 4 and 5 is also heated. Steam 6 is also superheated in this section of the furnace for use in the process of this invention.

The pre-heated crude oil cracking feed is then passed by way of pipe (line) 10 to the aforesaid vaporization unit 11, which unit is separated into an upper vaporization zone 12 and a lower zone 13. This unit 11 achieves primarily (predominately) vaporization of at least a significant portion of the naphtha and gasoline boiling range and lighter materials that remain in the liquid state after the pre-heating step. Gaseous materials that are associated with the preheated feed as received by unit 11, and additional gaseous materials formed in zone 12, are removed from zone 12 by way of line 14. Thus, line 14 carries away essentially all the lighter hydrocarbon vapors, e.g., naphtha and gasoline boiling range and lighter, that are present in zone 12. Liquid distillate present in zone 12, with or without some liquid gasoline and/or naphtha, is removed there from via line 15 and passed into the upper interior of lower zone 13. Zones 12 and 13, in this embodiment, are separated from fluid communication with one another by an impermeable wall 16, which can be a solid tray. Line 15 represents external fluid down flow communication between zones 12 and 13. In lieu thereof, or in addition thereto, zones 12 and 13 can have internal fluid communication there between by modifying wall 16 to be at least in part liquid permeable by use of one or more trays designed to allow liquid to pass down into the interior of zone 13 and vapor up into the interior of zone 12. For example, instead of an impermeable wall 16, a chimney tray could be used in which case vapor carried by line 17 would pass internally within unit 11 down into section 13 instead of externally of unit 11 via line 15. In this internal down flow case, distributor 18 becomes optional.

By whatever way liquid is removed from zone 12 to zone 13, that liquid moves downwardly into zone 13, and thus can encounter at least one liquid distribution device 18. Device 18 evenly distributes liquid across the transverse cross section of unit 11 so that the liquid will flow uniformly across the width of the tower into contact with packing 19.

Dilution steam 6 passes through superheat zone 20, and then, via line 21 into a lower portion 22 of zone 13 below packing 19. In packing 19 liquid and steam from line 21 intimately mix with one another thus vaporizing some of liquid 15. This newly formed vapor, along with dilution steam 21, is removed from zone 13 via line 17 and added to the vapor in line 14 to form a combined hydrocarbon vapor product in line 25. Stream 25 can contain essentially hydrocarbon vapor from feed 2, e.g., gasoline and naphtha, and steam.

Stream 17 thus represents a part of feed stream 2 plus dilution steam 21 less liquid distillate(s) and heavier from feed 2 that are present in bottoms stream 26. Stream 25 is passed through a mixed feed preheat zone 27 in a hotter (lower) section of the convection zone of furnace 1 to further increase the temperature of all materials present, and then via cross over line 28 into the radiant coils (tubes) 29 in the radiant firebox of furnace 1. Line 28 can be internal or external of furnace conduit 30.

Stream 6 can be employed entirely in zone 13, or a part thereof can be employed in either line 14 and/or line 25 to aid in the prevention of the formation of liquid in lines 14 or 25.

In the radiant firebox section of furnace 1, feed from line 28 which contains numerous varying hydrocarbon components is subjected to severe thermal cracking conditions as aforesaid.

The cracked product leaves the radiant fire box section of furnace 1 by way of line 31 for further processing in the remainder of the olefin plant downstream of furnace 1 as shown in USP '961.

Section 13 of unit 11 provides surface area for contacting liquid 15 with hot gas or gasses, e.g., steam 21. The counter current flow of liquid and gas within section 13 enables the heaviest (highest boiling point) liquids to be contacted at the highest hot gas to hydrocarbon ration and with the highest temperature gas at the same time.

Pursuant to the refinery integration aspect of this invention bottoms stream 26 of unit 11, which contains a substantial amount, if not most or all, of the distillate(s) in feed 2, is passed by way of line 26 to atmospheric distillation zone (column) 32 in a crude oil refinery which, in conventional fashion, separates feed 26 into various fractions thereof such as one or more kerosene fractions 33 and 34, atmospheric gas oil 35, and an atmospheric residue 36. Bottoms 36 can be sold as a product of the process or used as a feedstock for a catalytic cracking unit or employed in the production of heavy fuel oil or any combination thereof.

In a conventional olefin production plant, the preheated feed 10 would be mixed with dilution steam 21, and this mixture would then be passed directly from preheat zone 3 into the radiant section 29 of furnace 1, and subjected to severe thermal cracking conditions. In contrast, this invention instead passes the preheated feed at, for example, a temperature of from about 200 to about 350 F, into standalone unit 11 as shown in the embodiment of FIG. 1. As shown in FIG. 1, this unit is physically located outside of furnace 1.

In the embodiment of FIG. 1, unit 11 receives preheated feed from furnace 1 via line 10. In other embodiments of this invention preheat section 3 need not be used, and feed 2 fed directly into unit 11.

The embodiment of FIG. 1 is, for sake of clarity and understanding, a straight forward representation of this invention. In practice, the integration of the operation of section 13 with an existing crude oil refinery could be more complex. For example, stream 26, instead of being fed directly into refinery unit 32, can first be mixed with the crude oil feed that was normally introduced into unit 32 prior to this invention. Thus, in the embodiment of FIG. 1, stream 26 can be mixed with fresh crude oil feed 37 that was normally fed into unit 32 when no stream 26 was available. A mixture of crude oil feed and section 13 bottoms product 26 would then pass as a single feed mixture into unit 32. In such a case, unit 32 of FIG. 1 would produce at least one additional stream 38 that contains light gasoline/naphtha that was derived from crude oil feed 37.

The addition of stream 26 to conventional crude oil feed 37 has a very distinct advantage in that the quantity of distillates 33 through 35 recovered from unit 32 is very substantially increased over what would otherwise have been recovered from the processing in unit 32 of solely crude oil feed 37. Other advantages for the integration of section 13 with the normal operation of a crude oil refinery will be apparent to one skilled in the art, and are within the scope of this invention.

Figure 2:
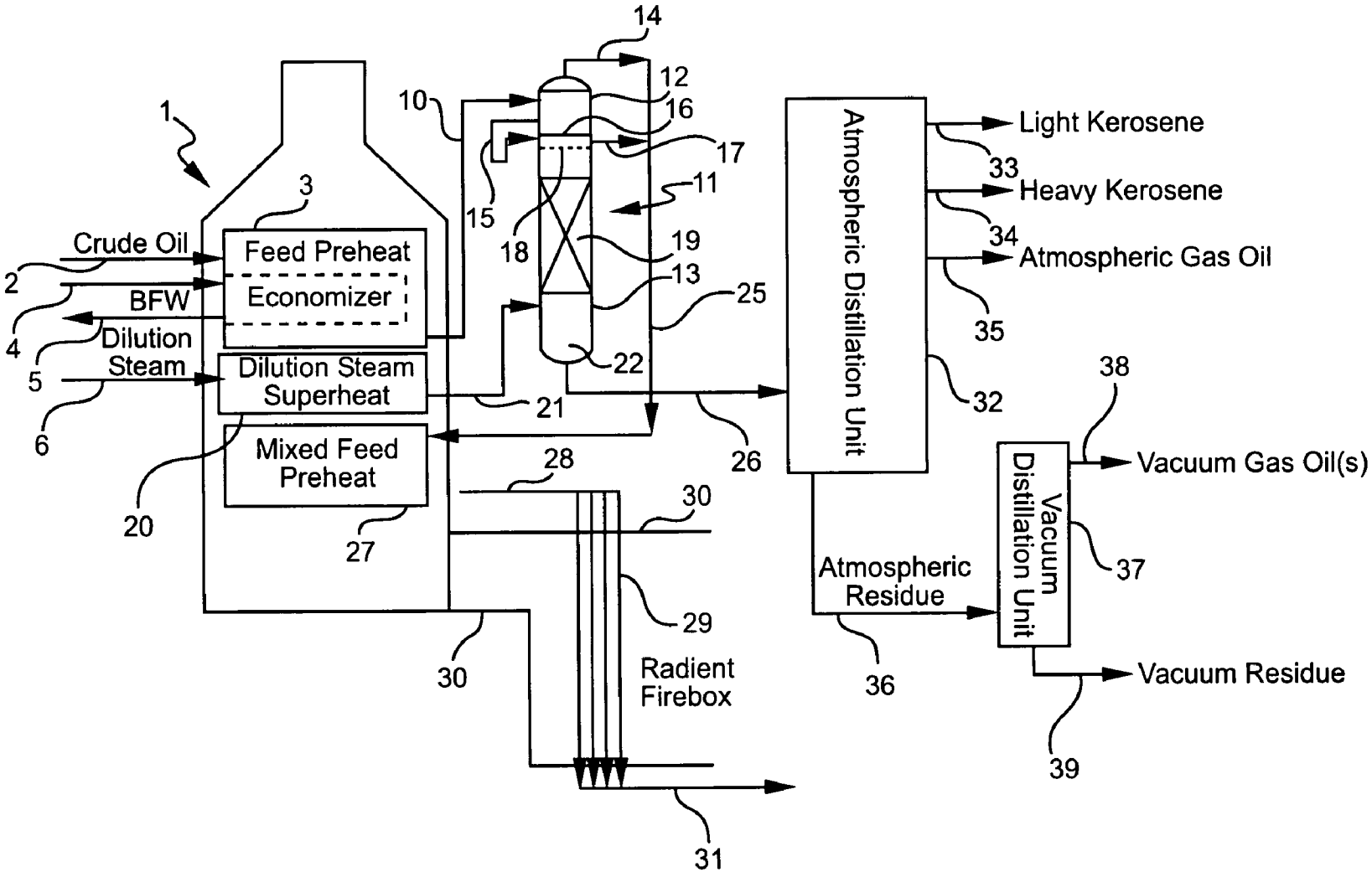
FIG. 2 shows another embodiment within this invention.

FIG. 2 shows yet another embodiment of a process within this invention. In FIG. 2, further crude oil refinery integration pursuant to this invention is shown. In FIG. 2, the atmospheric bottoms product 36 of FIG. 1 is transferred as feed to a conventional vacuum distillation unit 37 which separates feed 36 at least into at least vacuum gas oil fraction 38, thereby leaving a vacuum bottoms fraction 39. Vacuum gas oil fraction(s) 38 can be used as feed for a conventional catalytic cracking unit. Residue 39 can be used as feedstock for a conventional delayed coking unit.

In the illustrative embodiments of FIGS. 1 and 2, separated liquid hydrocarbon 15 contains most, if not all, of the distillate content of feed 2. Depending on the temperature of operation of section 12, liquid 15 can contain essentially only one or more distillate materials aforesaid or can contain such materials plus a finite amount of lighter materials such as naphtha. Sometimes it can be desirable to have a finite amount of naphtha in the distillate product, and this invention provides the flexibility to form a product stream 26 that is essentially only made up of distillate fractions or distillate fractions plus finite amounts of lighter fractions that make up feed stream 2.

Thus, if feedstock 2 boils in the range of from about 100 to about 1,350 F, and contains naphtha (boiling in the range of from about 100 to about 350 F) plus at least one distillate fraction (boiling, for example, mostly in the range of from about 350 to about 650 F) that feed can, pursuant to this invention, be preheated in unit 3 and further heated in unit 11 to vaporize essentially all the naphtha present for removal by way of lines 14 and 17. This could thereby leave essentially only liquid distillate to be recovered by way of line 26. The temperature of operation of units 3 and 11 to achieve this result can vary widely depending on the composition of feed 2, but will generally be in the range of from about 150 to about 500 F.

In the alternative, should it be desired to leave some naphtha in the liquid state with the distillate, as recovered by way of line 26, the temperature of operation of units 3, if used, and 11 can be altered to accomplish this result. When it is desired not to have essentially only distillate in stream 26, the amount of naphtha left in the liquid state for stream 26 can, with this invention, vary widely, but will generally be up to about 30 wt. % based on the total weight of naphtha, and distillates in stream 26. The temperature of operation of unit 3, if used, and unit 11 to achieve this result can vary widely depending on the composition of feed 2 and the amount of steam and pressure used, but will generally be in the range of from about 150 to about 450 F.

Stream 15 falls downwardly from zone 12 into lower, second zone 13, and can be vaporized as to any amounts of undesired liquid naphtha fractions initially present in zone 13. These gaseous hydrocarbons make their way out of unit 11 by way of line 17 due to the influence of hot gas 21, e.g., steam, rising through zone 13 after being introduced into a lower portion, e.g., bottom half or one-quarter, of zone 13 (section 22) by way of line 21.

Of course, units 3 and 11 can also be operated so as to leave some distillate in vaporous streams 14 and/or 17, if desired.

Feed 2 can enter furnace 1 at a temperature of from about ambient up to about 300 F at a pressure from slightly above atmospheric up to about 100 psig (hereafter "atmospheric to 100 psig"). Feed 2 can enter zone 12 via line 10 at a temperature of from about ambient to about 500 F at a pressure of from atmospheric to 100 psig.

Stream 14 can be essentially all hydrocarbon vapor formed from feed 2 and is at a temperature of from about ambient to about 400 F at a pressure of from atmospheric to 100 psig.

Stream 15 can be essentially all the remaining liquid from feed 2 less that which was vaporized in pre-heater 3 and is at a temperature of from about ambient to about 500 F at a pressure of from slightly above atmospheric up to about 100 psig (hereafter "atmospheric to 100 psig").

The combination of streams 14 and 17, as represented by stream 25, can be at a temperature of from about 170 to about 400 F at a pressure of from atmospheric to 100 psig, and contain, for example, an overall steam/hydrocarbon ratio of from about 0.1 to about 2, preferably from about 0.1 to about 1, pounds of steam per pound of hydrocarbon.

Stream 28 can be at a temperature of from about 900 to about 1,100 F at a pressure of from atmospheric to 100 psig.

Liquid distillate 26 can contain essentially only middle distillate boiling range and heavier components, or can be a mixture of such components and lighter components found in streams 14 and/or 17. Distillate stream 26 can be at a temperature of less than about 550 F at a pressure of from atmospheric to 100 psig.

In zone 13, dilution ratios (hot gas/liquid droplets) will vary widely because the composition of condensate varies widely. Generally, the hot gas 21, e.g., steam, to hydrocarbon ratio at the top of zone 13 can be from about 0.1/1 to about 5/1, preferably from about 0.1/1 to about 1.2/1, more preferably from about 0.1/1 to about 1/1.

Steam is an example of a suitable hot gas introduced by way of line 21. Other materials can be present in the steam employed. Stream 6 can be that type of steam normally used in a conventional cracking plant. Such gases are preferably at a temperature sufficient to volatilize a substantial fraction of the liquid hydrocarbon 15 that enters zone 13. Generally, the gas entering zone 13 from conduit 21 will be at least about 350 F, preferably from about 650 to about 1,000 F at from atmospheric to 100 psig. Such gases will, for sake of simplicity, hereafter be referred to in terms of steam alone.

Stream 17 can be a mixture of steam and hydrocarbon vapor that has a boiling point lower than about 350 F. It should be noted that there may be situations where the operator desires to allow some distillate to enter stream 17, and such situations are within the scope of this invention. Stream 17 can be at a temperature of from about 170 to about 450 F at a pressure of from atmospheric to 100 psig.

Packing and/or trays 19 provide surface area for the steam entering from line 21. Section 19 thus provides surface area for contacting down flowing liquid with up flowing steam entering from line 21. The counter current flow within section 13 enables the heaviest (highest boiling point) liquids to be contacted at the highest steam to oil ratio and, at the same time, with the highest temperature steam.

It can be seen that steam from line 21 does not serve just as a diluent for partial pressure purposes as does diluent steam that may be introduced, for example, into conduit 2 (not shown). Rather, steam from line 21 provides not only a diluting function, but also additional vaporizing energy for the hydrocarbons that remain in the liquid state. This is accomplished with just sufficient energy to achieve vaporization of heavier hydrocarbon components and by controlling the energy input. For example, by using steam in line 21, substantial vaporization of feed 2 liquid is achieved. The very high steam dilution ratio and the highest temperature steam are thereby provided where they are needed most as liquid hydrocarbon droplets move progressively lower in zone 13.

Unit 11, instead of being a standalone unit outside furnace 1, can be physically contained within the interior of convection zone of that furnace so that zone 13 is wholly within the interior of furnace 1. Although total containment of unit 11 within a furnace may be desirable for various furnace design considerations, it is not required in order to achieve the benefits of this invention. Unit 11 could also be employed wholly or partially outside of the furnace and still be within the spirit of this invention. Combinations of wholly interior and wholly exterior placement of unit 11 with respect to furnace 1 will be obvious to those skilled in the art and also are within the scope of this invention.

EXAMPLE

A natural gas condensate stream 5 characterized as Oso condensate from Nigeria is removed from a storage tank and fed directly into the convection section of a pyrolysis furnace 1 at ambient conditions of temperature and pressure. In this convection section, this condensate initial feed is preheated to about 350 F at about 60 psig, and then passed into a vaporization unit 11 wherein a mixture of gasoline and naphtha gases at about 350 F and 60 psig are separated from distillate liquids in zone 12 of that unit. The separated gases are removed from zone 12 for transfer to the radiant section of the same furnace for severe cracking in a temperature range of 1,450° F. to 1,550° F. at the outlet of radiant coil 29.

The hydrocarbon liquid remaining from feed 2, after separation from accompanying hydrocarbon gases aforesaid, is transferred to lower section 13 and allowed to fall downwardly in that section toward the bottom thereof. Preheated steam 21 at about 1,000 F is introduced near the bottom of zone 13 to give a steam to hydrocarbon ratio in section 22 of about 0.5. The falling liquid droplets are in counter current flow with the steam that is rising from the bottom of zone 13 toward the top thereof. With respect to the liquid falling downwardly in zone 13, the steam to liquid hydrocarbon ratio increases from the top to bottom of section 19.

A mixture of steam and naphtha vapor 17 at about 340 F is withdrawn from near the top of zone 13 and mixed with the gases earlier removed from zone 12 via line 14 to form a composite steam/hydrocarbon vapor stream 25 containing about 0.5 pounds of steam per pound of hydrocarbon present. This composite stream is preheated in zone 27 to about 1,000 F at less than about 50 psig, and introduced into the radiant firebox section of furnace 1.

Bottoms product 26 of unit 11 is removed at a temperature of about 460 F, and pressure of about 60 psig, and passed to atmospheric distillation unit 32 which is operated at an overhead temperature of about 250 F at about 3 psig to allow the removal from unit 32 of separate streams containing light kerosene boiling in the range of from about 330 to about 450 F, heavy kerosene boiling in the range of from about 450 to about 540 F, and atmospheric gas oil boiling in the range of from about 540 to about 650 F. The bottoms stream 36 is removed from unit 32 is removed at a temperature of about 650 F and pressure of about 5 psig.

It can be seen from the foregoing that this invention provides for the efficient separation of straight run naphtha boiling range and lighter material from whole crude oil, natural gas condensate, and mixtures thereof, while the separation of naphtha and lighter materials is integrated directly into the thermal cracking process to produce olefins in an energy and capital cost efficient manner, and while preserving the heavier materials for integration directly into the crude oil refining process to produce middle distillate boiling range components. One result of the refinery integration feature of this invention is the production from a refinery atmospheric distillation unit of light and heavy kerosene fractions that are best used directly in jet fuel and diesel fuel production. A further result of the refinery integration feature of this invention is the use of the atmospheric distillation unit bottoms as feed for a vacuum distillation unit for maximum upgrading. Vacuum gas oil from the vacuum distillation unit can be sent to a fluid catalytic cracking unit for gasoline production. This maximizes, for example, the efficient utilization of the crude oil feed by cracking the low octane straight run naphtha in a pyrolysis cracking furnace, separating the less abundant straight run middle distillate components, and maximizing high octane gasoline production through the use of vacuum gas oils as feed to a catalytic cracking unit.

I claim:

1. A thermal cracking process that employs at least one cracking furnace and a liquid feed for said cracking furnace, said liquid feed consisting essentially of whole crude oil containing petroleum middle distillate, natural gas condensate containing petroleum middle distillate, and mixtures thereof, said petroleum middle distillate boiling in the range of from about 350 to about 650 F, said liquid feed first being subjected to a vaporization step other than distillation that produces a vaporous output and a liquid bottoms fraction that is separate from said vaporous output, said vaporous output from said vaporization step being fed to said at least one cracking furnace, carrying out said vaporization step under conditions such that said liquid bottoms fraction that is recovered from said vaporization step contains a substantial amount of said at least one petroleum middle distillate that was originally present in said liquid feed, and subjecting said recovered liquid bottoms fraction to at least one of atmospheric distillation and vacuum distillation to produce at least one petroleum middle distillate product.

2. The method of claim 1 wherein said vaporous output boils at a temperature of about 330 F and lower, said vaporous output is used as feed to said at least one cracking furnace, said liquid bottoms fraction boils at a temperature of about 330 F and higher, and said liquid bottoms fraction is fed to an atmospheric distillation unit.

3. The method of claim 1 wherein said vaporization step is carried out at a temperature of from about 150 to about 500 F under autogenous pressures.

4. The method of claim 2 wherein said atmospheric distillation unit is operated under conditions which produce separate products comprising at least one kerosene fraction, atmospheric gas oil, and an atmospheric bottoms stream.

5. The method of claim 4 wherein said atmospheric distillation unit is operated to produce a light kerosene fraction, a separate heavy kerosene fraction, and said atmospheric bottoms stream is employed in at least one of the production of heavy fuel oil and feed for a catalytic cracking operation.

6. The method of claim 1 wherein said vaporous output boils at a temperature of about 330 F and lower, said vaporous output is used to feed said at least one cracking furnace, said liquid bottoms fraction boils at a temperature of about 330 F and higher, said liquid bottoms fraction is fed to an atmospheric distillation unit which is operated under conditions which produce separate products comprising at least one kerosene fraction, atmospheric gas oil, and atmospheric bottoms fraction, and said atmospheric bottoms fraction is fed to a vacuum distillation unit to produce vacuum gas oil and a vacuum residue.

7. The method of claim 6 wherein said vaporization unit is operated at a temperature of from about 150 to about 500 F under autogenous pressures.

8. The method of claim 6 wherein said vacuum distillation unit is operated to produce a vacuum gas oil fraction and a separate vacuum residue fraction, and said vacuum residue is employed as feed for a delayed coking unit.

* * * * *